United States Patent [19]

Mysliwiec

[11] Patent Number: 5,052,055

[45] Date of Patent: Oct. 1, 1991

[54] APRON

[76] Inventor: Laura J. Mysliwiec, 67 Megan Rd., Hyannis, Mass. 02601

[21] Appl. No.: 485,442

[22] Filed: Feb. 27, 1990

[51] Int. Cl.[5] ..... A41D 13/04

[52] U.S. Cl. ..... 2/48; 2/46; 2/51; 2/338

[58] Field of Search ..... 2/46, 47, 48, 51, 52, 2/174, 240, 271, 302, 304, 311, 312, 313, 314, 315, 316, 317, 318, 338, 340, 341, 342, DIG. 6

[56] References Cited

U.S. PATENT DOCUMENTS

| | | | |
|---|---|---|---|
| 147,479 | 2/1874 | Chiply | 2/5 |
| 211,479 | 1/1879 | Shelby | 2/316 |
| D. 231,810 | 6/1974 | Daley | 2/48 X |
| 699,513 | 5/1902 | Garms | 2/52 |
| 801,518 | 10/1905 | Fries | 2/52 |
| 968,299 | 8/1910 | White | 2/338 |
| 1,061,017 | 5/1913 | Schloss | 2/338 |
| 1,193,545 | 8/1916 | Hart | 2/51 |
| 1,306,800 | 6/1919 | Childs | 2/315 |
| 1,483,338 | 2/1924 | Dilling | 2/52 |
| 1,492,859 | 5/1924 | Robeson | 2/316 |
| 1,538,826 | 5/1925 | Kops | 2/338 |
| 1,657,868 | 1/1928 | Segal | 2/52 |
| 1,693,141 | 11/1928 | Ducat | 2/240 |
| 2,427,119 | 9/1947 | Bensel | 2/48 |
| 2,469,302 | 5/1949 | Kelleher | 2/69 X |
| 2,568,421 | 9/1951 | Van Staagen | 2/48 |
| 2,648,845 | 8/1953 | Berman | 2/48 |
| 2,655,659 | 10/1953 | Swearingen | 2/52 |
| 2,754,532 | 7/1956 | Kanehl | 15/209 |
| 2,756,430 | 7/1956 | West | 2/48 |
| 2,988,748 | 6/1961 | Whitley et al. | 2/48 |
| 3,004,315 | 10/1961 | Masure | 24/3 |
| 3,010,110 | 11/1961 | Kirk | 2/49 R |
| 3,105,974 | 10/1963 | Grazia | 2/338 |
| 3,501,774 | 3/1970 | Norman | 2/240 |
| 3,619,816 | 11/1971 | Cowen | 2/49 R |
| 3,624,686 | 11/1971 | Beals | 35/8 |
| 3,711,867 | 1/1973 | Mott | 2/315 X |
| 3,841,542 | 10/1974 | Hogensen, Jr. | 2/338 X |
| 3,848,270 | 11/1974 | Rand | 2/338 X |
| 3,984,876 | 10/1976 | Sutton | 2/48 |
| 4,079,465 | 3/1978 | Alexander | 2/48 |
| 4,295,231 | 10/1981 | Wright | 2/338 |
| 4,449,252 | 5/1984 | Sullinger | 2/46 |
| 4,564,957 | 1/1986 | Scharf | 2/DIG. 6 |
| 4,858,249 | 8/1989 | Stewart | 2/DIG. 6 X |
| 4,966,322 | 10/1990 | Zagorski et al. | 2/338 X |

FOREIGN PATENT DOCUMENTS

| | | | |
|---|---|---|---|
| 2604609 | 4/1988 | France | 2/49 R |
| 522722 | 4/1955 | Italy | 2/52 |
| 1392 | of 1905 | United Kingdom | 2/52 |
| 141883 | 4/1920 | United Kingdom | 2/52 |
| 528122 | 10/1940 | United Kingdom | 2/52 |
| 2050810 | 1/1981 | United Kingdom | 2/DIG. 6 |

OTHER PUBLICATIONS

Pamphet by Kauman Research Corp., "Strapet".

*Primary Examiner*—Werner H. Schroeder
*Assistant Examiner*—Jeanette E. Chapman
*Attorney, Agent, or Firm*—Blodgett & Blodgett

[57] ABSTRACT

Apron using a rectangular towel and having elongated elastic belt clamped to and connecting the upper corners of the towel.

10 Claims, 1 Drawing Sheet

APRON

BACKGROUND OF THE INVENTION

One of the aggravating problems that exists in the service industries is that of providing the employees with neat, clean aprons. This is particularly true in the restaurant business, because the waiters and chefs are expected by the customers to appear neat and clean. Nevertheless, they are subjected constantly to accidents which stain their aprons. The problem arises not only because valuable time is consumed in changing into a clean apron, but also that the cost of maintaining an adequate supply of aprons is prohibitive. This is particularly true in situations where fancy aprons are used, since such aprons must be sent out to a laundry for cleaning. The laundry service is expensive and a large number of aprons must be purchased by the business establishment to compensate for those aprons that are absent being laundered. These and other difficulties experienced with the prior art equipment have been obviated in a novel manner by the present invention.

It is, therefore, an outstanding object of the invention to provide an apron which is neat in appearance and which is inexpensive to maintain.

Another object of this invention is the provision of an apron belt for use in converting a simple towel to use as an apron.

A further object of the present invention is the provision of a belt for use in combination with a towel to form an apron.

It is another object of the instant invention to provide an apron belt which is simple in construction, which can be inexpensively manufactured, and which is capable of a long life of useful service.

A still further object of the invention is the provision of a belt for use in an apron assembly, wherein clamps are provided which do not snag during use.

It is a further object of the invention to provide a belt for use in an apron assembly, wherein an adjusting means is provided which does not snag during use.

It is a still further object of the present invention to provide an apron belt having means for readily forming a loop for hanging storage.

Another object of the invention is the provision of an apron belt having a broad outer surface provided with recognizable indicia.

With these and other objects in view, as will be apparent to those skilled in the art, the invention resides in the combination of parts set forth in the specification and covered by the claims appended hereto.

SUMMARY OF THE INVENTION

In general, the present invention consists of an apron for use on the waist of a person, the apron having a towel of generally rectangular shape with an upper edge adapted to extend around the front of the waist and with downwardly-directed side edges, an elongated elastic belt is provided that is adapted to extend around the rear of the waist, the belt having clamps at opposite ends to engage and hold the side edges of the apron near the junction of the side edges with the upper edge.

More specifically, the belt is provided with a means for adjusting its length, so that the combination of the length of the upper edge of the apron and the length of the belt approximates the distance around the waist. An inner surface of the belt is provided with widely-separated elements of a hook-and-loop fabric system, so that the elements can be pressed together to form a loop in the belt for hanging storage. An outer surface of the belt is provided with indicia that is displayed during use.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
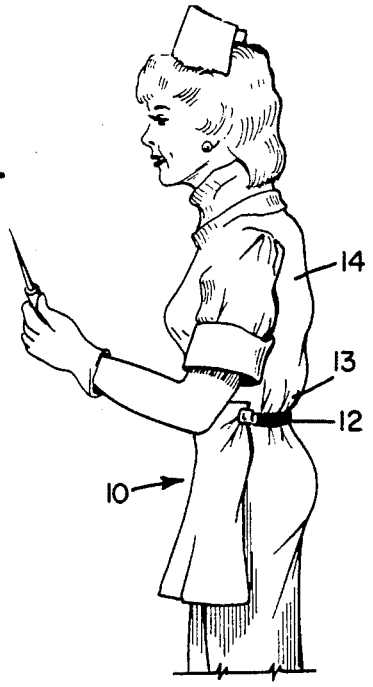
FIG. 1 is a perspective view of an apron incorporating the principles of the present invention, the apron being shown in use on a person.

Referring first to FIG. 1, wherein are best shown the general features of the invention, the apron indicated generally by the reference 10, is shown as consisting of a towel 11 and a belt 12. The apron is illustrated in use on the waist 13 of a person 14.

Figure 2:
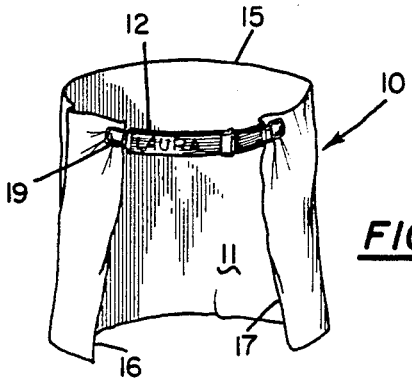
FIG. 2 is a perspective view of the apron as perceived from the rear.

As indicated in FIG. 2, the towel 11 has a generally rectangular shape and has an upper straight edge 15 which terminates in straight end edges 16 and 17. The belt 12 is elongated and elastic; it is provided at its ends with clamps 18 and 19 by which it is locked to and connects the parts of the towel 11 adjacent the junctions of the upper edge 15 with the end edges 16 and 17.

Figure 3:
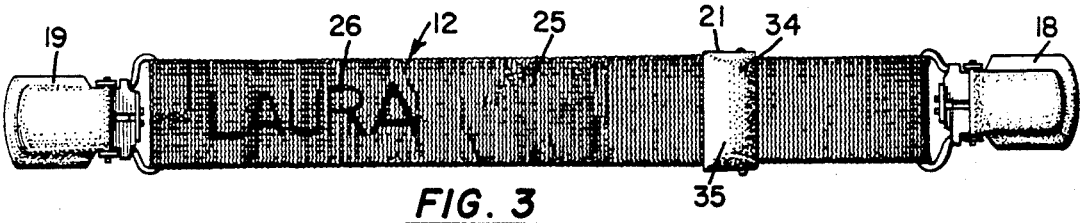
FIG. 3 is a front elevational view of an apron belt.
Figure 4:
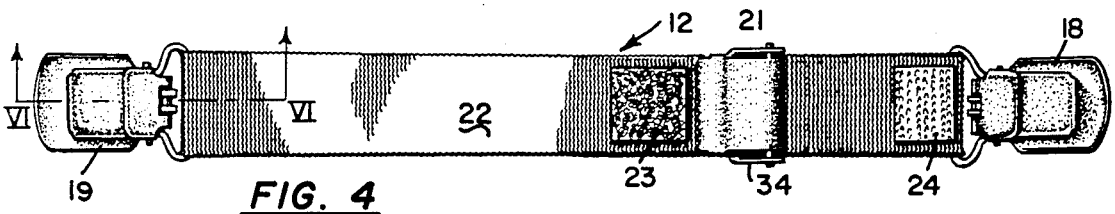
FIG. 4 is a rear elevational view of the apron belt.

FIGS. 3 and 4 show the details of the belt 12. It is provided with a means 21 for adjusting its length, so that the combination of the length of the upper edge of the apron and the length of the belt approximates the distance around the waist 13 of the person 14.

Figure 5:
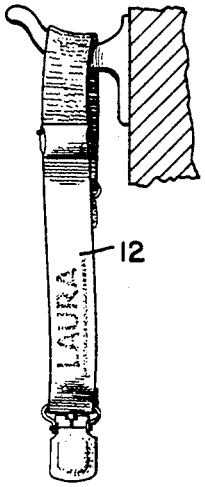
FIG. 5 is a perspective view of the apron belt shown in a storage mode.

An inner surface 22 of the belt is provided with widely-separated elements 23 and 24 of a hook-and-loop fabric system, known by the trademark VELCRO, so that the elements can be pressed together to form a loop in the belt for hanging storage, as shown in FIG. 5.

An outer surface 25 of the belt is provided with indicia 26 that is displayed during use.

Figure 6:
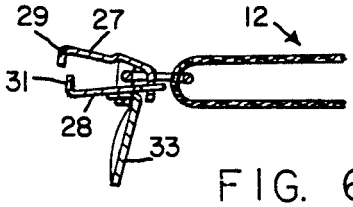
FIG. 6 is a sectional view of the apron belt taken on the line VI—VI of FIG. 4.

As is evident in FIG. 6, each of the clamps 18 and 19 consists of two hinged plates with serrated jaws 29 and 31 and a cam element 32 to lock the jaw in a clamping mode, the cam element having a smooth rounded outer surface 33 that eliminates snagging by the belt in use.

Referring again to FIGS. 3 and 4, it can be seen that the means 21 for adjusting includes a hinged locking plate 34 having a smooth rounded surface 35 facing outwardly of the belt to eliminate snagging by the belt in use.

The operation and the advantages of the present invention will now be readily understood in view of the above description. To begin with, it is contemplated that the towel 11 be selected to be very simple in fabrication and to be inexpensive. Most importantly, the towel should be made of a durable fabric, so that it can be repeatedly washed and ironed without substantial deterioration. In the preferred use, the towel can be laundered in the restaurant (or other business establishment) without the involvement with an outside laundry.

In this way, the "down time" is shortened, and a considerable portion of the expense eliminated.

In order to use the apron, it is only necessary to apply the clamp 18 to the upper, right hand corner of the towel 11. This is the corner formed by the junction of the upper edge 15 with the side edge 17. The towel is then stretched across the front of the waist 13 of the person 14 and the belt 12 is stretched across the back until it is possible to apply the clamp 19 to the corner formed by the intersection of the upper edge 15 of the towel with the end edge 16. If necessary, the length of the belt 12 can be adjusted by releasing the locking plate 34 of the adjusting means 21, making the adjustment, and re-establishing the locking function of the plate.

In order to store the belt 12, it is only necessary to press the elements 23 and 24 together to form a loop and to hang the belt on a hook, as shown in FIG. 5.

The smoothly-curved nature of the surface 33 of the clamp 19, as well as the corresponding surface of the clamp 18 and the surface 35 of the locking plate 21 assure that no catching or snagging can take place during use. The indicia 26 on the outer surface 25 of the belt can either identify the establishment or the person, such as a waitress. In addition, it identifies the ownership, when stored, as in FIG. 5.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Apron for use on the waist of a person, comprising:

(a) a towel of generally rectangular shape having an upper edge adapted to extend around the front of the waist and having downwardly-directed side edges, and (b) an elongated elastic belt adapted to extend around the rear of the waist, the belt having clamps at opposite ends to engage and hold the side edges of the apron near the junction of the side edges with the upper edge, wherein an inner surface of the belt is provided with widely-separated elements of a hook-and-loop fabric system, so that the elements can be pressed together to form a loop in the belt for hanging storage.

2. Apron as recited in claim 1, wherein the belt is provided with a means for adjusting its length, so that the combination of the length of the upper edge of the apron and a length of the belt approximates the distance around the waist.

3. Apron as recited in claim 1, wherein an outer surface of the belt is provided with indicia that is displayed during use.

4. Apron as recited in claim 1, wherein each clamp consists of two hinged plates with serrated jaws and a cam element to lock the jaws in a clamping mode, the cam element having a smooth rounded outer surface that eliminates snagging by the belt in use.

5. Apron as recited in claim 2, wherein the means for adjusting includes a hinged locking plate having a smooth rounded surface facing outwardly of the belt to eliminate snagging by the belt in use.

6. Apron belt for use on the waist of a person in combination with a towel of generally rectangular shape, the towel having an upper edge adapted to extend around the front of the waist and having downwardly-directed side edges, comprising:

an elongated elastic strip of fabric adapted to extend around the rear of the waist and having clamps at opposite ends to engage and hold the side edges of the apron near the junction of the side edges with the upper edge, wherein an inner surface of the belt is provided with widely-separated elements of a hook-and-loop fabric system, so that the elements can be pressed together to form a loop in the belt for hanging storage.

7. Apron as recited in claim 6, wherein the belt is provided with a means for adjusting its length, so that the combination of the length of the upper edge of the apron and the length of the belt approximates this distance around the waist.

8. Apron as recited in claim 6, wherein an outer surface of the belt is provided with indicia that is displayed during use.

9. Apron as recited in claim 6, wherein each clamp consists of two hinged plates with serrated jaws and a cam element to lock the jaws in a clamping mode, the cam element having a smooth rounded outer surface that eliminates snagging by the belt in use.

10. Apron as recited in claim 9, wherein the means for adjusting includes a hinged locking plate having a smooth rounded outer surface facing outwardly of the belt to eliminate snagging by the belt in use.

* * * * *